United States Patent [19]

Pagliaro

[11] 4,171,776

[45] Oct. 23, 1979

[54] DOOR MOUNTED ACTUATING MECHANISM FOR SPRAY CONTAINERS

[76] Inventor: Chris R. Pagliaro, 4829 St. Paul Ct., Hillside, Ill. 60162

[21] Appl. No.: 865,308

[22] Filed: Dec. 28, 1977

[51] Int. Cl.[2] ..... B05B 15/00

[52] U.S. Cl. ..... 239/274; 222/180; 222/509

[58] Field of Search ..... 239/274; 222/180, 325, 222/509

[56] References Cited

U.S. PATENT DOCUMENTS

| | | | |
|---|---|---|---|
| 2,534,464 | 12/1950 | Marini et al. | 239/274 |
| 3,033,471 | 5/1962 | Horn | 239/274 |
| 3,286,883 | 11/1966 | Takiff | 239/274 X |
| 3,739,949 | 6/1973 | Chimer et al. | 239/274 |
| 3,858,762 | 1/1975 | Meshberg | 239/274 X |
| 3,994,440 | 11/1976 | Mancini | 239/274 |
| 4,056,228 | 11/1977 | Rosenkrantz et al. | 239/274 |

FOREIGN PATENT DOCUMENTS

| | | | |
|---|---|---|---|
| 598830 | 5/1960 | Canada | 239/274 |

*Primary Examiner*—Robert W. Saifer

*Attorney, Agent, or Firm*—Leonard J. Kalinowski

[57] ABSTRACT

A door mounted actuating device for use with a spray container includes a frame for supporting the container and locating its spray nozzle at door top height, and an actuating mechanism having a pivotally mounted lever arm and a plunger assembly including a plunger rod movable to pivot the lever arm to depress the spray nozzle of the container causing a spray of fluid from the container both upon opening and closing of the door. The lever arm carries an adjustable member adjacent to the nozzle which is adjustable to vary the amount of spray. The plunger rod is adjustable to permit the actuating unit to spray only upon opening of the door, and a stop mechanism of the plunger assembly is adjustable to permit the actuating unit to spray only upon closing of the door.

21 Claims, 10 Drawing Figures

DOOR MOUNTED ACTUATING MECHANISM FOR SPRAY CONTAINERS

BACKGROUND OF THE INVENTION

1. Field of the Invention

This invention relates to spray apparatus, and more particularly, to an actuating device for use with a spray container for causing a spray of deodorant, disinfectant, insecticide, or the like, into a room in response to opening or closing of the door, for example.

2. Description of the Prior Art

Various door operated spray apparatus have been proposed in the prior art. Such apparatus generally include a frame for supporting a can of pressurized liquid such as deodorant, disinfectant, insecticide or the like, typically in aerosol form. The apparatus further includes an actuating mechanism adapted to depress a spray nozzle of the container to discharge fluid into a room in response to either the opening or closing of a door on which the apparatus is mounted.

One such spray apparatus, for actuating an aerosol spray can, is shown in the U.S. Pat. No. 3,662,958 which was issued to Paul German on May 16, 1972. The apparatus includes an actuating mechanism having a plunger positioned to be operated in response to the closing of a door on which the apparatus is mounted to effect discharge of a spray. The plunger has one end which is disposed adjacent to the door molding. As the door is closed, the plunger is carried into engagement with the door molding, and the plunger slides in a guide sleeve, moving its other end into engagement with a cam, rotating the cam. During its rotating movement, the cam depresses a leaf spring which in turn depresses the valve of the aerosol can thereby causing a spray of a quantity of fluid into a room. The cam returns to its rest position so that during the next opening of the door, the valve is not actuated.

Another spray apparatus is disclosed in the U.S. Pat. No. 3,608,784, which was issued to Jackson E. Brown. In this apparatus, a can containing spray disinfectant is supported by a vertical guide, and a spray head on the can is aligned with and contacts a reciprocating plunger, which is actuated by a toggle arrangement, to cause a discharge spray of disinfectant into a room both upon opening or closing of the door on which the apparatus is mounted.

Both of these devices have the common characteristic that the actuating mechanism assembly is positioned above the valve head of the spray can. This requires increased size for the actuating unit to accomodate the "overhead" mounted actuating mechanism. In addition, this also results in the spray nozzle of the can being located below the top of the door so that vaporization of the spray may not be optimum, and may be hazardous to occupants of the room.

In U.S. Pat. No. 2,534,464, to Thomas M. Marini, there is disclosed a door operated atomizer device which is designed to be mounted above a door and to be operated by an actuating means engaging the door. The actuating means includes a pivotally mounted lever arm one end of which engages the nozzle of the can and the other end of which is operated by a plunger arm which is moved vertically in response to opening and closing movement of the door. However, in many installations, particularly residential applications, there is not sufficient clearance above the door to the ceiling to mount such device. While the reference indicates the apparatus may be mounted horizontally and thus could be positioned at the side of a door, it is evident that such mounting would permit rapid discharge of the propellant, shortening the useful life of the aerosol can.

A further consideration is that known prior art devices are not adaptable to different types of installations. For example, each device requires an actuator member, such as a plunger rod, which must engage the door frame, the door molding or the top of the door to effect a discharge of fluid. However, in known devices, no adjustment is provided for such plunger rod which permit the spray can actuating mechanism to be used in a large number of different installations. Also, while actuating devices have been provided which permit a spray to be provided upon either (1) opening of a door, (2) upon closing of a door, or (3) upon opening or closing of a door, none of these prior art devices is readily adaptible for operation under any one of the three conditions, depending upon application.

Also, it is known that the height of spray cans varys with manufacturers. Thus, actuating devices have been proposed which include adjustable means to allow adjustment, within certain limits, to accomodate spray cans of different heights to maintain the nozzle in contact with the actuating mechanism. For example, the frame shown in the Brown Patent, employs adjustable top and bottom holders for this purpose. The apparatus shown in the Patent to German includes an adjusting screw disposed to engage the bottom of the can and which is adjustable to urge the can vertically upward so that its nozzle engages the nozzle actuating mechanism. While this height adjustment device is much simpler than that employed by Brown, it is noted that the tip of the adjustment screw engages the bottom of the aerosol can at a point where it is prestressed and thus subject to puncture.

SUMMARY OF THE INVENTION

The present invention has provided an actuating device for use with a spray container of the type having a spray nozzle which when depressed causes a spray of fluid to be emitted from the container. The actuating device comprises a frame having support means for supporting the container and further support means for supporting a nozzle actuating means in operative relationship with the nozzle of the container. The actuating means includes lever means pivotally mounted for rotation about a pivot axis which extends adjacent to a side surface of the nozzle, the lever means having a first end disposed adjacent to a top surface of said nozzle, and plunger means mounted for reciprocating motion between first and second positions along an axis which extends generally parallel to the pivot axis of the lever means. The plunger means has a cam surface which is moved to contact the lever means adjacent to a second end thereof upon movement of the plunger means between first and second positions, the lever means causing the first end to depress the nozzle effecting a spray discharge of fluid from the container.

In accordance with a disclosed embodiment, the lever means includes a lever arm and an operating means carried by the end of the lever arm which is adjacent to the nozzle. The lever is pivotally mounted in an off-set relation relative to the nozzle of the container, the pivot axis being coplanar with the top of the nozzle. The plunger means via its cam surface, causes pivotal movement of the lever arm in response to opening and closing of the door. As the door closes, the cam surface of the plunger means is moved to engage the lever arm with travel of the plunger, and to pass out of engagement with the lever arm permitting the lever arm to restore to its rest position under the force of the valve spring of the container. With the next opening of the door, the plunger means moves in the opposite direction with the cam surface again engaging and passing beyond the lever arm, pivoting the lever arm.

The provision of a "side-mounted" nozzle actuator not only minimizes the vertical height of the unit, but also optimizes the amount of fluid discharge with each operation by providing arcuate movement of an actuating lever arm, rather than a direct vertical movement, as employed in most known prior art devices. Also, this side mounting permits location of the spray nozzle of the spray container near the top of the door.

The operating means also serves as a means for accomodating spray cans of different heights, within certain limits. In a disclosed embodiment, the operating member comprises an adjustable screw member which is carried by the lever arm and which is adjustable to normally engage the top surface of the nozzle. Such adjusting means is simple in construction, and its location at the nozzle rather than at the bottom of the container will not result in inadvertant puncturing of the prestressed bottom surface of the container.

In accordance with a feature of the invention, the door actuated spray device is normally operable to effect a spray of fluid from the container both upon opening and closing of a door, and is readily adjustable to be operable to effect a spray only upon opening or upon closing of the door. To this end, the plunger means is adjustable to limit its travel whereby with full stroke its cam surface remains in contact with the lever arm. For such embodiment, a metered spray valve is used, providing a spray. Also, in a further embodiment, a stop member prevents the plunger means from returning to its rest position, providing spray only upon opening the door.

The actuating device employs relatively few parts, and is easily mounted on a door by an unskilled person. Also, the unit may be secured to the top surface of the door thereby minimizing the damage to the door surface, and eliminating the need for screw holes in the face of the door or the adjacent door frame.

DESCRIPTION OF PREFERRED EMBODIMENTS

Figure 1:
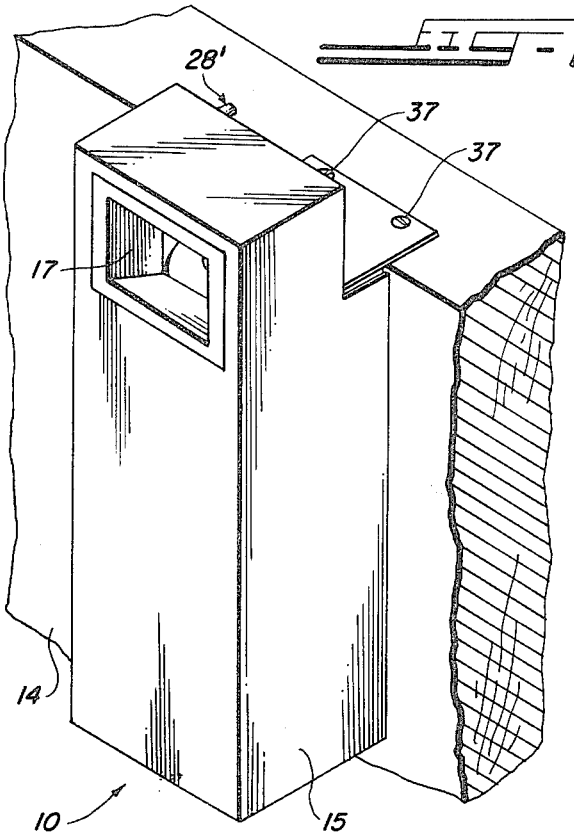
FIG. 1 is a perspective view of a door mounted actuating device provided by the present invention.
Figure 2:
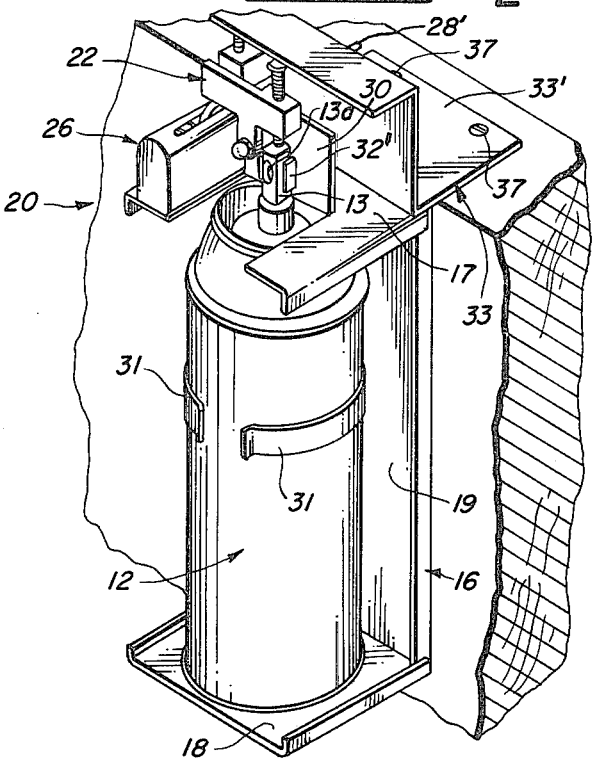
FIG. 2 is a view of the actuating device shown in FIG. 1 with the cover removed.

With reference to FIGS. 1 and 2, the actuating device 10 provided by the present invention is adapted for use with a spray container, such as container 12 shown in FIG. 2, which has a spray nozzle 13 which when depressed, causes a discharge of fluid, such as a deoderant, a disinfectant, an insecticide, or the like, from the container via an orifice 13A in the nozzle. The actuating device 10 is shown secured to a door 14 to be operated upon opening and/closing of the door, causing the fluid to be sprayed into a room. The container 12 may be a conventional aerosol container, that is pressurized, or the head 13 may actuate a pump to discharge the fluid.

As shown in FIG. 1, the actuating unit includes a suitable housing or cover 15 which is mounted on the frame 16 enclosing the container and the actuating mechanism. The cover 15 has an aperture 17 which is in alignment with the discharge orifice 13A in the nozzle of the container. The housing is open at its rearward side to facilitate mounting on the frame 16 (FIG. 2), and may be secured thereto in a suitable manner.

As shown in FIG. 2, the actuating unit 10 includes an actuating mechanism 20 which is disposed in operative relationship with the nozzle 13. The actuating mechanixm 20 includes a lever arm assembly 22 and a plunger assembly 26. The lever arm assembly 22, shown best in FIG. 5, includes a pivotally mounted lever arm 27 which has one end disposed adjacent to the top surface of the nozzle 13 and its other end disposed adjacent to the plunger block assembly 26. The plunger block assembly, 26, shown best in FIG. 4, includes a plunger or slide rod 28 which is adapted to be moved within a plunger block 29 in response to opening or closing of the door 14, to thereby carry a cam surface 60 thereof into engagement with end 27B of the lever arm, to pivot the lever arm 27, which in turn depresses the spray nozzle.

Figure 6:
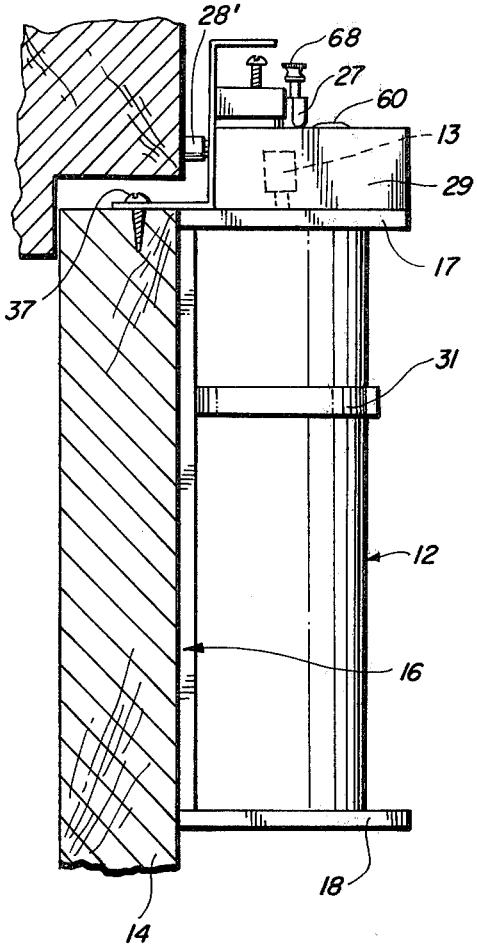
FIG. 6 is a simplified representation of the actuator device shown mounted on a closed door.

As shown in FIG. 2, the actuating device 10 is secured to the upper surface of the door 14 by way of mounting plate 33, and a rubber snubber 28" on the free end of the plunger rod 28 is positioned to engage a surface above the door, such as an upper molding of the door as shown in FIG. 6, whenever the door 14 is closed. For purposes of illustration, it is assumed that the actuating assembly is mounted on a door which is normally open, so that the plunger rod is normally maintained out of engagement with surface such as the door molding, and cam surface 60 is disengaged from the lever arm. The lever arm is thus maintained at its "rest" position by the force of the valve.

As the door is closed, the push rod engages the molding and is moved inward causing the cam surface 60 to engage the lever arm 27, pivoting the lever arm to its operating position to depress the nozzle 13 effecting a spray of the fluid into the room. With continued travel of the push rod, the cam surface 60 moves beyond the lever arm (FIG. 6) which restores to its rest position under the force of the valve spring. When the door reopened, the plunger rod is moved in the opposite direction, moving the cam surface 60 into moved engagement with the lever arm 27, pivoting the lever arm to its operative position providing a second spray discharge. With further travel of the rod, the lever arm is pivoted back to its inoperative position by the force of the valve mechanism 13. While in the preferred embodiment the actuating unit effects a spray of fluid into the room on both opening and closing of the door, as will be shown hereinafter, in other embodiments the actuating unit 10 includes an adjustment means which permits the spray container to be actuated upon opening of the door, closing of the door, or both.

Considering the actuating unit 10 in more detail, as shown in FIG. 2, the actuating unit includes a frame 16 which supports the container 12 and which mounts the actuating mechanism 20. The frame 16 comprises a top plate 17 and a bottom plate 18 which are mounted in parallel spaced relation by a rear plate 19. The container 12 is supported on the bottom plate 18, and a resilient clamping 31 retains the container within the frame. The resilient clamping arms are secured to the rear plate 19 in a suitable manner. The top surface of plate 17 mounts the actuating mechanism 20 in operative relationship with the valve nozzle 13. A vertical plate member 30 which extends perpendicular to the top plate, mounts the lever arm 27 in offset relation with the nozzle, and has a pair of outwardly projecting tabs 32 which define a nozzle guide for the nozzle 13 to prevent rotational movement of the nozzle when the container is mounted in the device 10.

Figure 3:
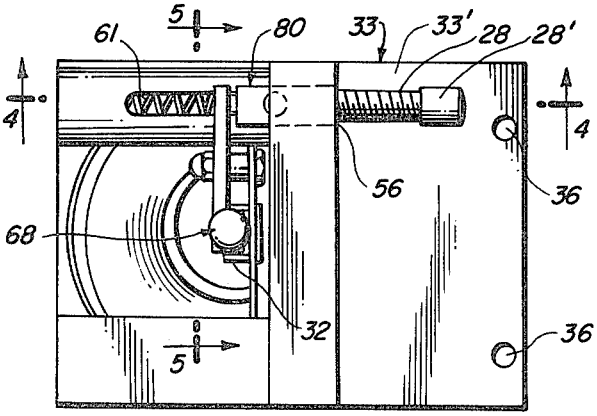
FIG. 3 is a top elevation view of the actuating device shown in FIG. 2.

An L-shaped mounting bracket 33, which is secured to the top plate 17 in a suitable manner, has a horizontally extending portion 33' (FIG. 3) which extends beyond the back plate 19 defining the mounting plate, which has a pair of apertures 36 which permit the assembly 10 to be secured to the top surface of the door as by screws 37. Such mounting allows the actuating unit 10 to be secured to the top of the door by screws without damage done to the face of the door or to the side moldings. In some installations particularly commercial applications, it may be desireable to further secure the unit to the face of door as by screws (not shown) extending through the back plate 19 and into the hardwood portion of the door.

Figure 4:
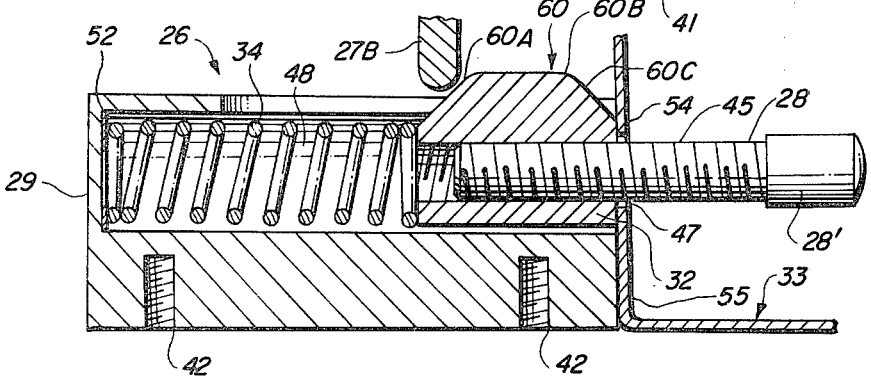
FIG. 4 is a sectional view of a plunger mechanism of the actuating device taken along lines 4—4 of FIG. 3.

With reference to the actuating mechanism 20 as shown best in FIG. 4, the plunger block assembly 28 includes plunger block 29, plunger arm 28, a slide collar 32, and a restoring or bias spring 34. The slide block 29 is secured to the upper surface to the top plate 17 by a suitable means, such as screws 41 shown in FIG. 5, which extend through the top plate 17 into tapped holes 42 in the under surface of the block. The plunger arm has a threaded shank 45 which is received in a central threaded bore 47 of the slide collar which in turn is located in a central bore 48 of the plunger block for reciprocating motion therewithin. The bias spring 34 is disposed between one end of the slide collar and an inner surface 52 of the plunger block to normally bias the slide collar and plunger arm outwardly. A stop plate 54 formed by the vertical surface 55 of the mounting bracket 33 serves as a limit stop for the slide collar.

The plunger rod 28 extends through an aperture 56 (FIG. 3) in the vertical plate and is received in threaded engagement with the slide collar. The adjustable plunger rod 28 permits adaption of the unit to door moldings of different configurations. The diameter of the aperture 56 is greater than the outer diameter of snubber 281, allowing minimum clearance between the back of the unit and the striking surface.

The slide collar has upper cam surface 60 which is carried by the slide collar and extends through a slot 61 (FIG. 3) in plunger block 29 to engage the under side of the lever arm as the slide collar is moved to the left in FIG. 4 in response to closing of the door. In the illustrated embodiment, the cam which is generally trapesoidal in shape, has a generally flat top with an approximately 45° angle taper along its sides forming a tapered bearing surface to permit the end 27B of the lever arm 27 to first ride up the cam surface portion 60A as the slide collar is moved to the left, moving the lever arm to its operative position. With continued movement of the slide collar to the left, the upper surface 60B of the cam is moved along the underside of the lever arm. When the door is closed, the cam surface 60C has been moved past the lever arm, permitting the lever arm to be restored to its inoperative position by the valve 13. It is pointed out that cam surfaces of other configurations may be used.

Figure 5:
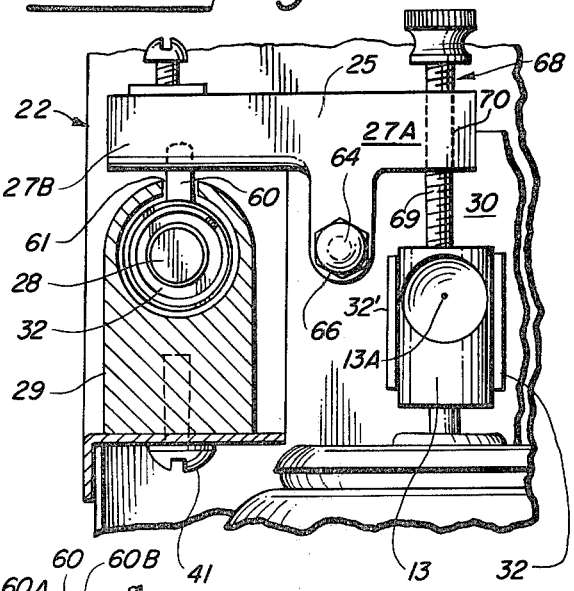
FIG. 5 is a sectional view of the actuating mechanism taken along lines 5—5 of FIG. 3.

With reference to FIG. 5, the lever arm is generally T-shaped and is pivotally mounted at its base to the vertical plate which carries a pivot rod 64, the end of which may be threaded, permitting lever arm 27 to be maintained thereon by a nut 66. As indicated, one end of the lever arm extends adjacent to the cam surface 60 of the plunger actuating member 26 and the other end of the lever arm extends adjacent to the upper surface of the nozzle 13. The end of the lever arm which is disposed adjacent to the nozzle carries an adjustable screw to allow the actuating device to accomodate containers of different heights. The adjusting screw also permits the amount of spray discharge to be varied. In the exemplary embodiment, the adjusting screw has a threaded shank portion 69 which extends through a threaded aperture 70 in one side of the lever arm. When the container is in place in the assembly 10 the screw is adjusted to engage the top of the nozzle.

Figure 7:
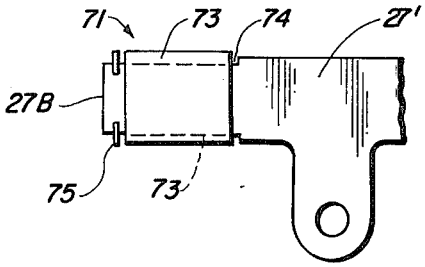
FIG. 7 is a front elevation view of a lever arm which may be employed in the actuating device; and, FIGS. 8, 8A and 8B are simplified representations of the actuating mechanism, and are used in describing the operation of the actuating unit.

Referring to FIG. 7, in a further embodiment, lever arm 27' includes a bearing assembly, indicated generally at 71, which minimizes wearing effects at the point of contact of the lever arm and the cam surface 60. The bearing assembly 71 includes a bushing 73 carried by the lever arm adjacent to its end 27B, enabling rolling engagement of the end of the lever arm with the cam surface 60 on the slide collar. The bushing 73 is received on a shoulder portion 74 of lever arm and held thereon by suitable means such as an E-ring 75.

For purposes of illustration, the actuating device 10 has been disclosed as comprising a number of individual parts, which may be of metal or plastic material. When plastic elements are used, the unit may be manufactured employing molding techniques allowing the entire assembly, aside from the plunger rod the slidable collar and lever arm, screw, for example, to be molded as a one piece unit, with the cover being connected to the frame by way of a "living hinge".

Operation

With reference to FIGS. 2–5, assuming that the door is normally open, the slide collar 32 and plunger arm 28 are biassed by the spring 34 so that the plunger arm extends outwardly from the plunger block. In such position, the cam surface 60 is moved out of engagement with the end 27B of the lever arm 27, and the lever arm is moved to its inoperative position under the force of the nozzle 13. Then when the door is closed, the end of the plunger rod is moved into engagement with the molding above the door (FIG. 6), moving the slide collar to cause the cam 60 to engage the end of the lever arm. This pivots the lever arm and its other end, 27A via operator screw 68 depresses the nozzle 13, causing a discharge of the fluid into the room.

As shown best in FIG. 5, the center line of the pivot point for the lever arm extends in a plane which locates the top of the nozzle 13. Thus, the lever arm is effectively side-mounted relative to the nozzle 13. This maximizes the amount of force for small incremental movement of the lever arm, and effects maximum vertical travel when the lever arm is pivoted.

When the door is fully closed, (FIG. 6), the cam has been moved past the lever arm, permitting the lever arm to restore to its inoperative position under the control of the valve spring of the nozzle 13. The next time the door is opened, and the end of the plunger rod is disengaged from the molding, the bias spring 34 causes the slide collar 32 to move towards the right in FIG. 4, causing the cam 60 to reengage the lever arm 26, pivoting the lever arm to effect another spray of fluid into the room.

With the plunger mechanism being operated by the upper molding of the door, and the side-mounting of the lever arm assembly, the nozzle of the container 12 is located at or above the top of the door. This provides efficient vaporization dispersement of the fluid discharged, when the unit is actuated, and also minimizes hazards to persons in the room.

Figure 8:
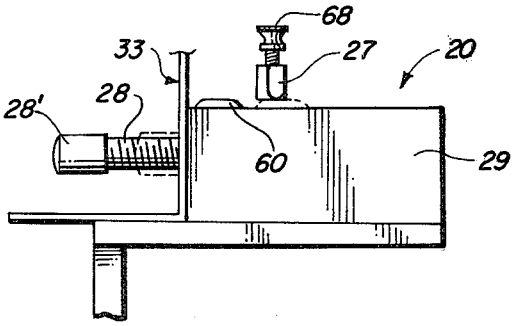

In the foregoing embodiment, the actuating unit 10 provides a spray both upon opening and closing of the door. As indicated above, the plunger rod is adjustable to compensate for different door molding configurations. Such feature can advantageously be used to provide spray of liquid only upon closing of the door, when a spray container having a metered valve is used. More specifically, with the plunger rod adjusted to the position indicated in FIG. 8, the inward travel of the slide block is limited by the shorter travel of the push rod, so that the cam surface is moved to a position at which it engages the free end of the lever arm continuously when the door is closed. Thus, the lever arm remains pivoted while the door remains closed. However, the metered nozzle provides only a predetermined amount of spray when it is depressed.

When the door is thereafter reopened, the slide block moves, causing the cam to be moved out of engagement with the lever arm under the force of the restoring spring, permitting the lever arm to be returned to its inoperative position. However, no spray is effected from this operation.

Figure 8A:
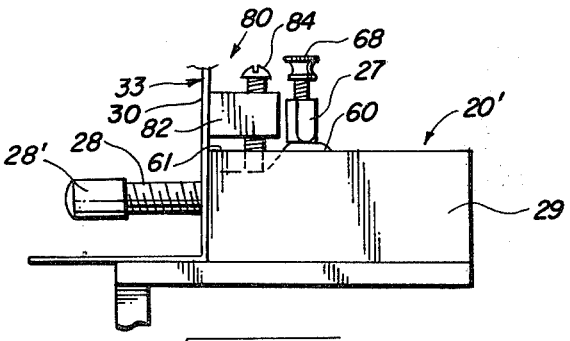

With reference to FIG. 8A, there is shown a simplified view of an actuating assembly 20' for a further embodiment for the actuator device in which an adjustable device 80 permits the unit to spray only upon opening of the door. The adjustable device 80 includes a stop member, or shim, 84 which is mounted to the vertical plate 30 by a suitable means, such as a horizontally extending mounting block 82. The stop member is an adjustable member, embodied as screw 84, which in FIG. 8A, is shown with its end extending into the slot 61 of the plunger block 29 to limit the travel of the slide collar 32. More specifically, the free end of the screw 84 extending into the slot 61 is engaged by one side 60C of the cam 60 when the cam is moved under the force of the bias spring of the plunger block assembly. It is pointed out in this embodiment, a spray can of the "timed discharge" is required.

Figure 8B:
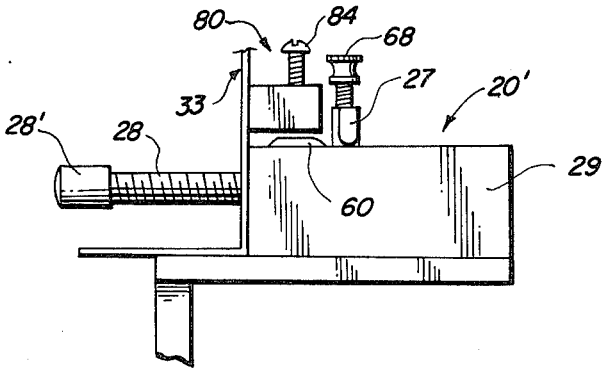

In operation, of this embodiment, whenever the door is open, the cam 60 is maintained in contact with the free end of the lever arm which is thus maintained in an operative position. When the door is then closed and the plunger arm engages the molding above the door, the slide collar is moved carrying the cam surface out of engagement with the lever arm which then restores to its inoperative position. When the door is thereafter reopened and the slide rod disengages the molding, the slide collar is moved under the force of the bias spring 34, moving the cam surface into engagement with the lever arm pivoting the lever arm which causes a discharge of the fluid into the room. In FIG. 8B, the adjustable member is shown in disengaged position which permits the actuating unit to operate as described above so that a spray is provided both upon opening and closing of the door.

I claim:

1. An actuating device for use with a spray container of the type having a spray nozzle which when depressed causes a spray of fluid to be emitted from the container, said actuating device comprising a frame having support means for supporting said container, and nozzle actuating means, said frame having further support means for supporting said nozzle actuating means in operative relationship with said nozzle, said actuating means including lever means pivotally mounted for rotation about a pivot axis which extends adjacent to a side surface of said nozzle, said lever means having a first end disposed adjacent to a top surface of said nozzle, and plunger means mounted for reciprocating motion between first and second positions along an axis which extends generally parallel to the pivot axis of said lever means, said plunger means having a cam surface which is moved to contact said lever means adjacent to a second end thereof upon movement of said plunger means between said first and second positions, to pivot said lever means, causing said first end to depress said nozzle.

2. An actuating device as set forth in claim 1 wherein said lever means comprises a lever arm, and operating means carried by said lever arm adjacent to said first end, said operating means being manually adjustable to permit said operating means to normally engage said top surface of said nozzle.

3. An actuating device as set forth in claim 2 wherein said operating means comprises a mounting member secured to said lever arm, and an operating member having a threaded shank portion received in a threaded aperture of said mounting member, and having an end portion extending towards the top surface of said nozzle, said operating member being adjustable to permit said end portion to normally engage said top surface of said nozzle.

4. An actuating device as set forth in claim 1 wherein said frame includes mounting means for permitting said actuating device to be secured to a top surface of said door with the nozzle located near the top of the door.

5. An actuating device as set forth in claim 1 wherein said plunger means includes a plunger arm movable along said axis between said first and second positions, said cam surface engaging said second end of said lever means to pivot said lever means each time said plunger arm is moved to a given position which is intermediate said first and second positions.

6. An actuating device as set forth in claim 5 wherein said lever means includes bearing means disposed adjacent to its second end for engagement by said cam surface of said plunger means.

7. An actuating device as set forth in claim 5 wherein said plunger means includes means for limiting axial movement of said plunger arm between said intermediate position and one of said other positions.

8. An actuating device as set forth in claim 5 wherein said actuating device is mounted on a door, said further support means including means for locating said plunger arm with an operating end thereof disposed adjacent to a surface above the door, and bias means for normally biasing said plunger arm to said first position when said door is open, and, as said door is closed, said operating end being moved to engage said surface and to cause axial movement of said plunger arm against the force of said bias means, from said first position towards said second position, said bias means causing axial movement of said plunger arm from said second position towards said first position as said door is opened and said operating member is disengaged from said surface.

9. An actuating device for use with a spray container of the type having a spray nozzle which when depressed causes a spray of fluid to be emitted from the container, said actuating device comprising a frame attachable to a door adjacent to the top thereof and having support means for supporting said container with its spray nozzle disposed at a level above the level of the top surface of the door, and nozzle actuating means, said frame having further support means for supporting said nozzle actuating means in operative relationship with said nozzle, said actuating means including a lever arm pivotally mounted for rotation about an axis, said lever arm having one end disposed adjacent to the top of said nozzle, nozzle operating means carried by said lever arm adjacent to said one end, said nozzle operating means being manually adjustable to different operating positions relative to the top surface of said nozzle, and an actuating member located along side said nozzle and positioned for cooperation with a surface above the door, and operable to pivot said lever arm as the door is moved between closed and open positions, moving said one end towards said nozzle and causing said operating means to depress said nozzle.

10. An actuating device as set forth in claim 9 wherein said nozzle operating means is adjusted to one of said operating positions to normally engage the top surface of said nozzle, and is adjustable to other ones of said operating positions to control the amount of fluid spray.

11. An actuating device as set forth in claim 9 wherein said operating means comprises a mounting member secured to said lever arm, and an operating member having a threaded shank portion received in a threaded aperture of said mounting member and having an end portion extending towards the top surface of said nozzle, said operating member being adjustable to permit said end portion to normally engage said top surface of said nozzle.

12. An actuating device for use with a spray container of the type having a spray nozzle which when depressed causes a spray of fluid to be emitted from said container, said actuating device comprising a frame member attachable to a door, adjacent to the top thereof, said frame member having support means for supporting said container, and nozzle actuating means, said frame member having further support means for supporting said nozzle actuating means in operative relationship with said nozzle, said actuating means including a lever arm pivotally mounted for rotation about an axis, said lever arm having a first end disposed adjacent to the top of said nozzle, and plunger means mounted on said frame member and including a plunger arm having an operating portion disposed in operative relationship with a second end of said lever arm and having an end disposed adjacent to a surface above the door, whereby upon closing of said door, said end of said plunger arm is moved to engage said surface and cause axial movement of said plunger arm, moving its operator portion into engagement with the second end of said lever arm, pivoting said lever arm, to cause its first end to depress said nozzle, said plunger means including travel adjust means for adjusting the length of axial movement of said plunger arm.

13. An actuating device as set forth in claim 12 wherein said plunger means includes a plunger block secured to said frame, said plunger arm being mounted in said plunger block for reciprocating movement between first and second positions, and bias means for normally biasing said plunger arm towards said first position.

14. An actuating device as set forth in claim 13 wherein said travel adjust means comprises a collar member having an external bearing surface which is slidably movable along an inner bore of said plunger block, and an internally threaded central bore, said plunger arm having a threaded shank portion which is adjustably received within said central bore of said collar member.

15. An actuating device as set forth in claim 13 wherein said frame member has a rearward surface which extends in contact with a surface of said door when said frame member is attached to said door, said frame member including a mounting portion which extends perpendicular to said rearward surface and parallel to the top surface of the door, to permit said actuating device to be secured to the top surface of the door.

16. An actuating device as set forth in claim 15 wherein said plunger block is mounted recessed relative to said rearward surface of said frame member with said plunger arm extending outwardly therefrom and overlying said mounting portion.

17. An actuating device as set forth in claim 12 wherein said operating portion of said plunger arm comprises a cam disposed on a surface of said plunger arm adjacent to the opposite end of said lever arm, said cam being moved to engage said opposite end of said lever arm as said plunger arm is moved between said first and second positions.

18. An actuating device as set forth in claim 17 wherein said cam is generally trapesoidal in shape having a top bearing surface and substantially identical side bearing surfaces which engage said opposite end of said lever arm, sequentially, as said plunger arm is moved between said first and second positions.

19. An actuating device for use with a spray container of the type having a spray nozzle which when depressed causes a spray of fluid to be emitted from said container, said actuating device comprising a frame member having support means for supporting said container, and mounting means for permitting said actuating device to be secured to a top surface of said door and carried by the door as it is moved between open and closed positions, said support means locating the nozzle of said container at a level above the level of the top surface of the door, and nozzle actuating means, said frame member having further support means for supporting said nozzle actuating means in operative relationship with said nozzle and for locating an actuating member thereof to extend along side the nozzle and in position for cooperation with a surface above the door, at a level which is substantially the same as the level of the nozzle, upon movement of the door between its closed and open positions.

20. An actuating device for use with a spray container of the type having a spray nozzle which when depressed causes a spray of fluid to be emitted from the container, said actuating device comprising a frame attachable to a door and having support means for supporting said container, and nozzle actuating means, said frame having further support means for supporting said nozzle actuating means in operative relationship with said nozzle, said actuating means including lever means mounted for rotation about a pivot axis which extends adjacent to a side surface of said nozzle, said lever means having a first end disposed adjacent to a top surface of said nozzle, and plunger means mounted for reciprocating motion between first and second positions along an axis which extends substantially coplanar with the pivot axis of said lever means, said plunger means having an operating portion which is moved to contact said lever means adjacent to a second end thereof upon movement of said plunger means between said first and second positions, to pivot said lever means, causing said first end to depress said nozzle.

21. An actuating device for use with a spray container of the type having a spray nozzle which when operated causes a spray of fluid to be emitted from said container, said actuating device comprising a frame member having support means for supporting the container, and mounting means for permitting said actuating device to be secured to a door with the nozzle of the container located near the top of the door, and nozzle actuating means supported on said frame member in operative relationship with said nozzle and having an operating member with one end disposed for cooperation with a surface above the door to effect operation of the nozzle in response to movement of the door between open and closed positions, said actuating means including an elongated guide member for supporting said actuating member for reciprocating movement axially thereof, said guide member being mounted on an upper surface of the frame member with a rearward end of the guide member disposed in an offset relation relative to a rearward surface of said frame member, whereby said rearward end of said guide member is spaced apart from said surface above the door when the door is in a closed position.

* * * * *